United States Patent [19]

Guimond et al.

[11] 4,428,039

[45] Jan. 24, 1984

[54] SAFETY LAMP APPARATUS INCLUDING MEANS FOR PREVENTING ACCIDENTAL BREAKAGE OF A BULB MEMBER

[75] Inventors: Roy A. Guimond, Holden; Charles F. Daly, Boylston; John E. Gulliksen, Shrewsbury, all of Mass.

[73] Assignee: Koehler Manufacturing Company, Marlborough, Mass.

[21] Appl. No.: 360,833

[22] Filed: Mar. 23, 1982

[51] Int. Cl.[3] ..... F21V 15/04

[52] U.S. Cl. ..... 362/287; 313/50; 313/634; 362/106; 362/288; 362/320; 362/164; 362/223; 362/390; 362/198; 362/306; 362/397

[58] Field of Search ..... 313/50, 220, 222; 362/20, 105, 106, 151, 164, 198, 287, 288, 306, 320, 390, 396–398, 803, 223

[56] References Cited

U.S. PATENT DOCUMENTS

| | | | |
|---|---|---|---|
| Re. 30,498 | 1/1981 | Baldwin | 362/390 X |
| 1,955,396 | 4/1934 | Unk et al. | 313/50 |
| 3,032,646 | 5/1962 | Chieger | 362/320 X |
| 3,300,637 | 1/1967 | Martland | 362/377 |
| 4,071,749 | 1/1978 | Balogh | 362/20 |
| 4,075,472 | 2/1978 | Higuchi | 362/16 X |
| 4,112,485 | 9/1978 | Sutter | 362/390 X |
| 4,146,918 | 3/1979 | Tureck | 362/16 |
| 4,176,263 | 11/1979 | Rousseau | 362/802 X |
| 4,240,853 | 12/1980 | Pustka | 362/306 X |

FOREIGN PATENT DOCUMENTS

| | | | |
|---|---|---|---|
| 2806071 | 8/1979 | Fed. Rep. of Germany | 362/390 |
| 971866 | 10/1964 | United Kingdom | 362/198 |

*Primary Examiner*—Peter A. Nelson

*Attorney, Agent, or Firm*—Hamilton, Brook, Smith & Reynolds

[57] ABSTRACT

Safety lamp apparatus, suitable for use as a miner's cap lamp, includes a housing body closed at one side by a plastic light transmitting member. A bulb member is yieldably received in the housing body and is operable, when energized, to provide a filament in a state of incandescence for emitting visible radiation. During use of the apparatus in an explosive atmosphere conditions may arise where deformation of the light transmitting member from external impact forces directed thereagainst may drive deformed portions of the light transmitting member against the bulb member with sufficient force to cause bulb breakage and resulting explosion of the atmosphere.

In the present invention protective means is provided comprising an arrangement of parts defining an oblique angular relationship between the central longitudinal axis of the bulb member and the impacting surface of the deformed portion of the light transmitting member. The protective means may, in one desirable form, include a cylindrical projection from the inner surface of the light transmitting member truncated such that the plane of truncation lies at an oblique angle to the central longitudinal axis of the bulb member. With this arrangement impact against the bulb, arising from deformation of the light transmitting member, causes angular displacement of the bulb and thus breakage is avoided. The oblique angular relationship may also be realized with other arrangements of parts as hereinafter disclosed.

9 Claims, 23 Drawing Figures

Fig. 8
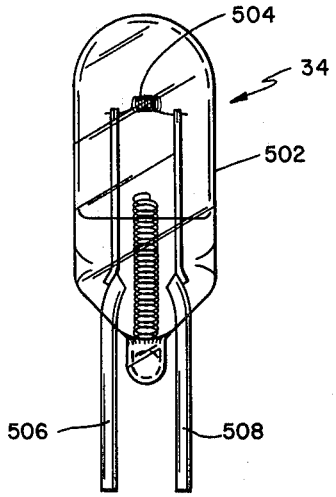
Fig. 9
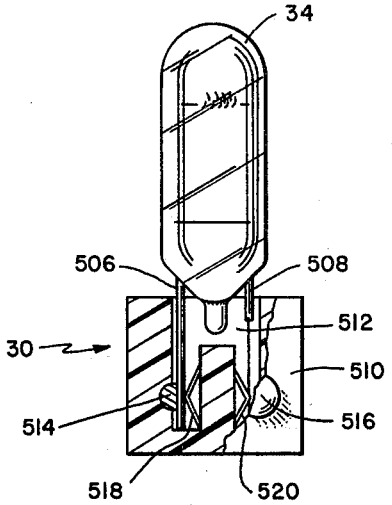
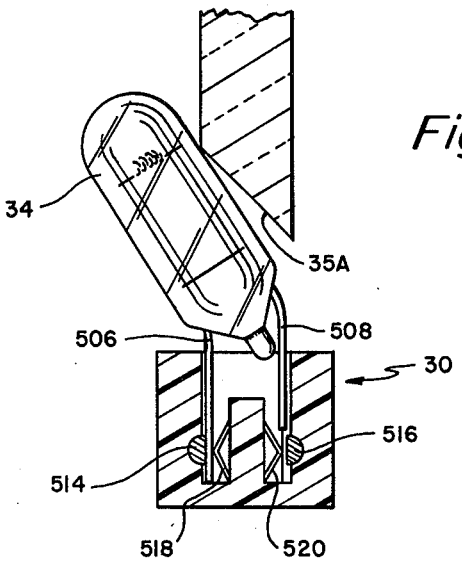
Fig. 10

Fig. 11
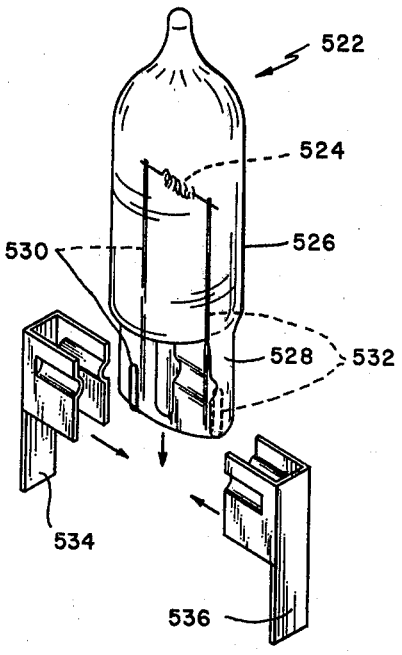
Fig. 12
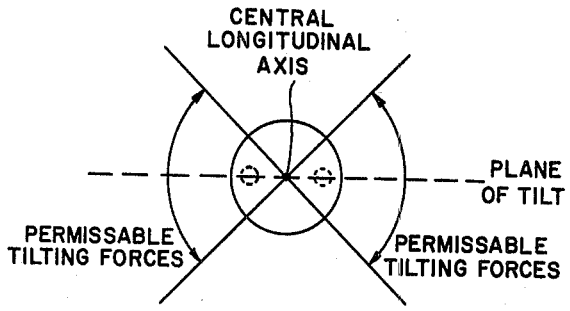
Fig. 13
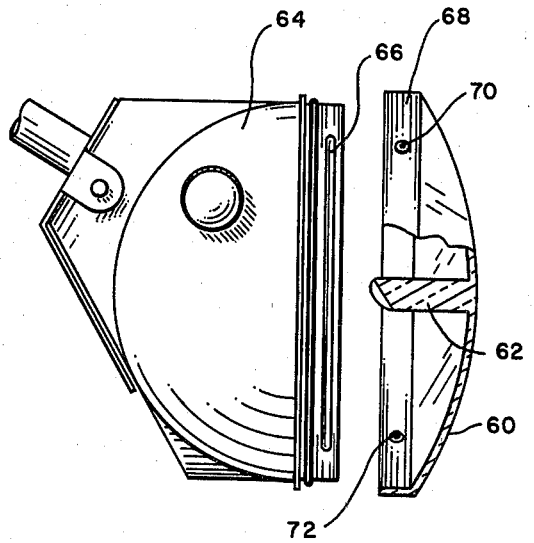
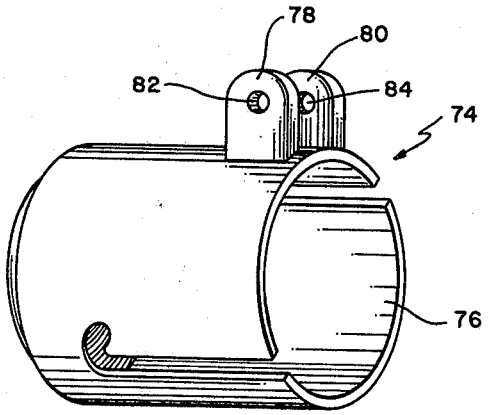
Fig. 14

Fig. 19
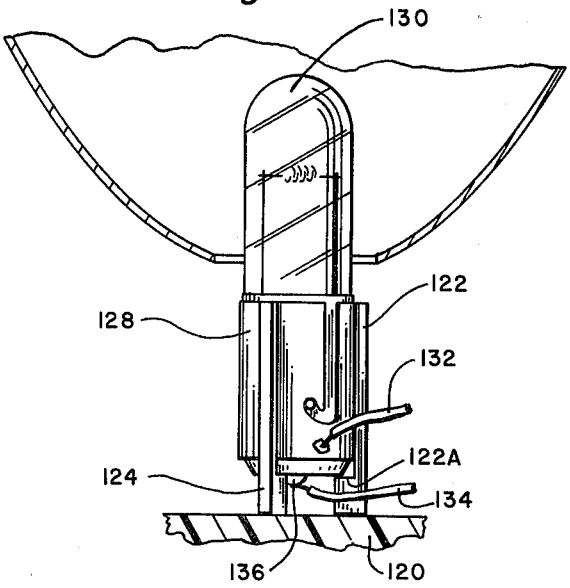
Fig. 20
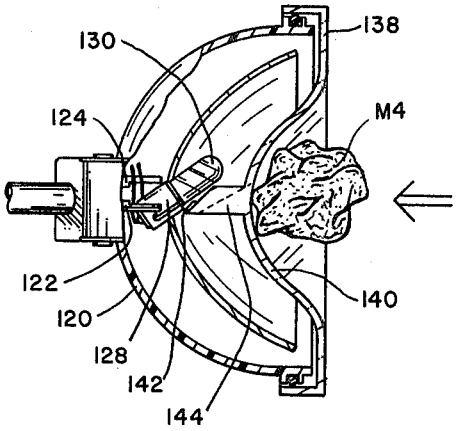
Fig. 21
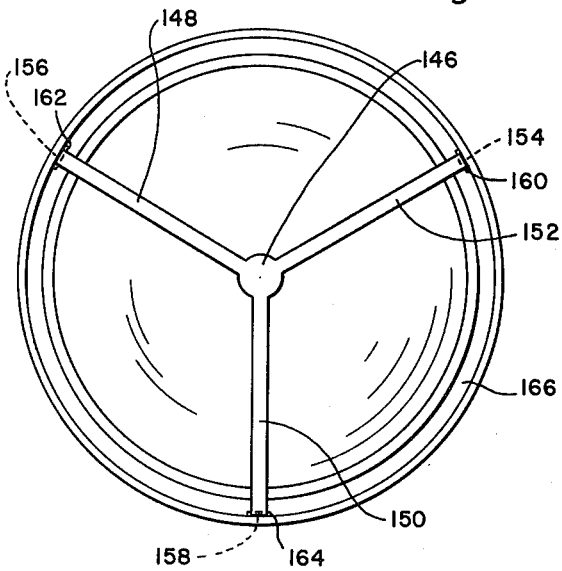
Fig. 22
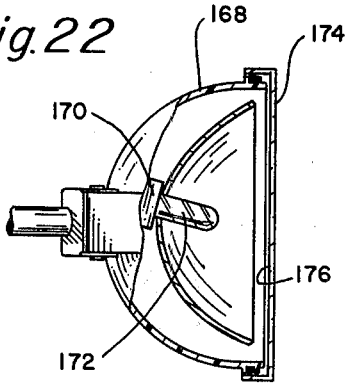
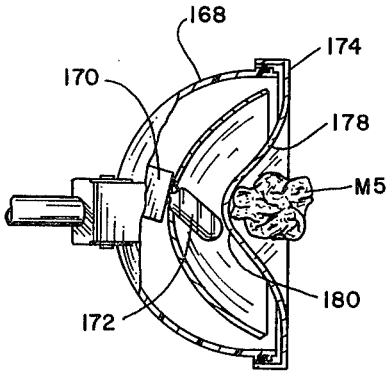
Fig. 23

SAFETY LAMP APPARATUS INCLUDING MEANS FOR PREVENTING ACCIDENTAL BREAKAGE OF A BULB MEMBER

FIELD OF THE INVENTION

Luminaire apparatus intended for use in explosive atmospheres such as, for example, a miner's cap lamp, customarily includes a bulb member having one or more incandescent filaments. The bulb is contained in a housing body closed by a light transmitting member in which an explosive atmosphere may, at times, be present. In the event that a flying mass of rock or other foreign body is hurled into contact with the light transmitting member it may result in bulb breakage and subsequent ignition of the explosive atmosphere by the filament.

One approach to solving this problem has been to enclose the bulb means in an enclosure body which is not susceptible to rupture or deformation by a projectile or other externally applied force, thus preventing exposure of an incandescent filament to the explosive atmosphere. This generally produces a luminaire body which is too heavy or bulky for portable use as a miner's cap lamp.

Two alternative approaches are commonly used in miner's cap lamps and other safety-type luminaires. The first such approach comprises filament quenching means arranged in spring-loaded arrangement against the bulb envelope such that rupture of the said envelope allows the quenching means to snap across, either breaking the filament or rapidly cooling the filament below the ignition temperature of the atmosphere.

The second approach is to spring load the bulb against a retainer element in contact with the bulb envelope such that rupture of the envelope allows displacement of the bulb member in a direction which will cause interruption of the electrical contact between the filaments of the bulb member and the power supply.

Both of these alternatives are subject to similar limitations, to wit:

(1) Tolerances of the parts must be sufficiently tight so as to insure reliable quenching and/or interruption of the electrical current path when the envelope is ruptured;

(2) The filament must be constructed such that when de-energized or quenched it will cool to a point below the ignition temperature of the atmosphere so rapidly that ignition will not take place; and (3) Both approaches require some element to be maintained in contact with the wall of the bulb means, and in the case where a halogen-filled bulb is desirable these elements render the use of such a bulb impractical. The envelope wall of a halogen bulb must be maintained at a high temperature or else the halogen cycle will not take place, and thus these approaches make the use of a halogen-filled bulb impractical.

SUMMARY OF THE INVENTION

This invention relates to a safety luminaire apparatus for use especially in an explosive atmosphere which may be found in mines and the like, and the safety luminaire apparatus may include the use of a halogen-filled bulb as well as other types of bulbs.

It is a chief object of the invention to provide a safety luminaire construction in which means are provided for preventing impact forces suddenly exerted against a deformable light transmitting member of the apparatus from causing accidental breakage of a bulb in which an incandescent filament may be housed.

It is a further object to devise, in a safety luminaire apparatus, an arrangement of parts by which breakage of the bulb, resulting from impact forces of a foreign body directed against a deformable light transmitting member of the luminaire, may be prevented by utilizing the deformation of the said light transmitting member to angularly change the position of the bulb and thus prevent bulb breakage.

Another object of the invention is to devise a safety luminaire apparatus in which a light transmitting component of the apparatus has internally located thereon bulb tilting means of unique character.

It has been found that these objectives may be realized by yieldably mounting the bulb member in the luminaire apparatus and by combining with the deformable light transmitting member protective means comprising an arrangement of parts which define an oblique angular relationship between the central longitudinal axis of the bulb member and the impacting inner surface of the light transmitting member. Deformation of the light transmitting member thus is forced to impart an angular displacement to the bulb member and breakage of the bulb member may thus be avoided.

The said arrangement of parts may, in one preferred form, include a deflector part which is formed integrally with the inner surface of the light transmitting member. The deflector part may comprise a cylindrical projection, truncated to provide a bulb engaging surface such that the plane of this surface lies at an oblique angle to the central longitudinal axis of the bulb member.

The arrangement of parts may be modified in several different ways, as is hereinafter disclosed. In addition, means for yieldably mounting the bulb member is disclosed in several different forms.

BRIEF DESCRIPTION OF THE DRAWINGS

FIG. 8 is a detail side elevation of one form of bulb means of the class shown in FIG. 6 and illustrating in more detail the incandescent filament of the bulb and associated electrical conductors.

FIG. 9 is a side elevation partially broken away showing the bulb means of FIG. 8 yieldably mounted in one desirable form of socket assembly and electrical contacts therefor.

FIG. 10 is a view similar to FIG. 8, but showing the protective means having tilted the bulb member with a resulting de-energization of its filament.

FIG. 11 is a detail view of an alternative form of bulb and contact means with which the arrangement of parts comprising protective means may be employed.

FIG. 12 is a diagrammatic representation illustrating quadrants of permissible tilting of bulbs of the types shown in FIGS. 8 and 11.

FIG. 13 is a side elevation of an alternate form of luminaire apparatus of the invention in which provision is made for rotation of the light transmitting member throughout a limited arc of rotation of approximately 90 degrees.

FIG. 14 is a perspective view of a yieldably mountable socket member in which may be received bulb means having a conventional bayonet type base.

FIG. 19 is a detail fragmentary view of portions of the apparatus of FIG. 18.

FIG. 20 is a diagrammatic view illustrating the socket of FIGS. 18 and 19 being moved by deformation of a light transmitting member.

FIG. 21 is a front elevation of an alternate form of luminaire construction, having its light transmitting member removed, and including a separately formed bulb tilting member.

FIG. 22 is a partial plan view of an alternate form of luminaire apparatus of the invention in which the central longitudinal axis of a bulb member lies in an oblique angular relationship to the inner surface of the light transmitting member.

FIG. 23 is a diagrammatic view illustrating the apparatus of FIG. 22 with its bulb member being displaced by the deformation of the light transmitting member without breakage occurring.

DETAILED DESCRIPTION OF THE INVENTION

Figure 1:
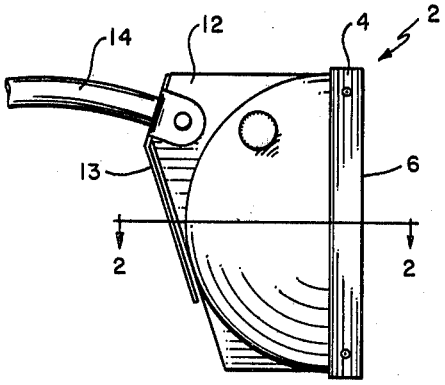
FIG. 1 is a side elevation of a type of luminaire apparatus with which the invention is concerned.

The present invention in general relates to a safety luminaire apparatus which may be employed in a miner's cap lamp or in other applications where there may be exposure to explosive atmospheres as, for example, frequently occurs in mines.

More particularly the invention is concerned with those conditions under which bulb breakage may occur in a safety luminaire apparatus when a light transmitting member of a yieldable nature is subjected to deformation as a result of impact forces externally exerted thereagainst.

In accordance with the invention, protective means are provided comprising an arrangement of parts in the luminaire apparatus by means of which such deformation of the light transmitting member will impart an angular displacement to the bulb member rather than causing its breakage. It has been found that this angular displacement may be imparted through the utilization of several different arrangements of parts, as illustrated in the drawings.

Figure 2:
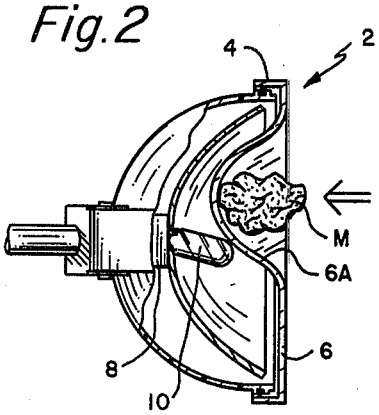
FIG. 2 is a diagrammatic view illustrating deformation of a light transmitting member of the apparatus by impact forces directed thereagainst and with deformed portions having been driven inwardly against a bulb member without bulb breakage occurring.
Figure 3:
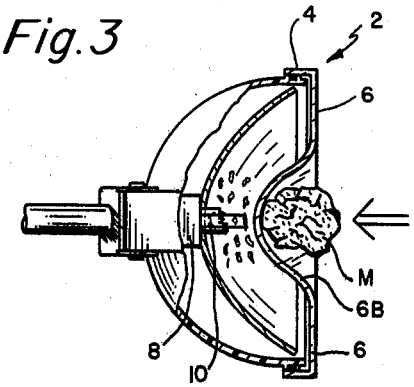
FIG. 3 is a diagrammatic view similar to FIG. 2, but showing a deformed part of the light transmitting member driven against the bulb to cause breakage.
Figure 4:
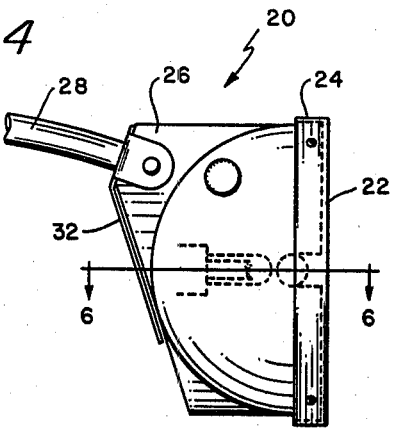
FIG. 4 is a side elevational view of a luminaire apparatus of the invention generally similar to the apparatus of FIGS. 1–3, but including one preferred arrangement of parts comprising protective means.

Referring in more detail to the drawings, attention is first directed to FIGS. 1–3 which are believed to be an aid in understanding the manner in which an impact on a deformable light transmitting member of a conventional luminaire may cause ignition of an explosive atmosphere.

Numeral 2 denotes a typical luminaire housing body which is closed at one side by a light transmitting member 6 of a yieldably plastic material, for example. This light transmitting member includes bezel ring portion 4, as is more clearly shown in FIGS. 2 and 3. It is pointed out that, alternatively, the bezel ring portion 4 may be formed separately of the light transmitting member. Located centrally of the inner side of the housing 2 is a socket 8 in which is yieldably received a bulb 10. The housing 2, in the particular arrangement shown, is designed for use in a miner's cap lamp and includes an extension body 12 through which may be located an electrical cable 14 to be connected to a battery (not shown), and also includes a cap hook 13 for attaching the luminaire to a miner's helmet. It should be understood that if this form of luminaire apparatus is employed where an explosive atmosphere is present there may be entry of the explosive atmospheres into the space inside the housing 2 and surrounding the bulb 10. Therefore an explosion becomes possible if the bulb envelope should rupture and if the filament should ignite the atmosphere.

It will also be observed that in each of the FIGS. 1–3 the bulb 10 and the light transmitting member 6 have a common longitudinal central axis and, with this relationship of parts, there are two conditions which may arise. If, as shown in FIG. 2, a flying object M such as a mass of rock or other foreign body exerts sudden impact forces against the light transmitting member at a slightly off-center point there will occur deformation indicated diagrammatically by numeral 6A of FIG. 2. The deformed part 6A is driven against a side of the bulb 10 exerting a glancing blow instead of striking the bulb head on. When this occurs, it has been found that the bulb 10, in some types of sockets, will become tilted into an angled position, as shown in FIG. 2, and no breakage and thus no explosion will take place. It is pointed out that the bulb member must be yieldably mounted in order for this to occur.

In FIG. 3 there is illustrated impact by a flying object M whose path of travel is along the central longitudinal axis of the bulb. In such a case the light transmitting member 6 may have a deformed part 6B which may be driven against the bulb 10 head on causing breakage, as is suggested diagrammatically in FIG. 3. In this case an explosion can occur, even though the bulb member may be yieldably mounted.

In comparison with the above, FIGS. 4–23 inclusive illustrate the improved luminaire apparatus of the invention characterized by protective means comprising an arrangement of parts, in several different forms, by which deformation of a light transmitting member may be forced to impart an angular displacement to the bulb member, thereby precluding the occurrence of bulb breakage and subsequent ignition of the atmosphere.

One preferred arrangement of parts for imparting such angular displacement is illustrated in FIGS. 4–10, wherein numeral 20 denotes a housing member which is closed at one side by a light transmitting member 22 formed with a bezel ring portion 24. The housing 20 is formed with an extension body 26 through which is received a cable 28 which is designed to be connected to a storage battery member (not shown) and which at its inner end is connected, through switching means (not shown), to electrical contacts in a socket 30, more clearly shown in FIGS. 6 and 7. Housing extension 26 is provided with a cap hook 32 for attaching the apparatus to a miner's helmet.

Figure 5:
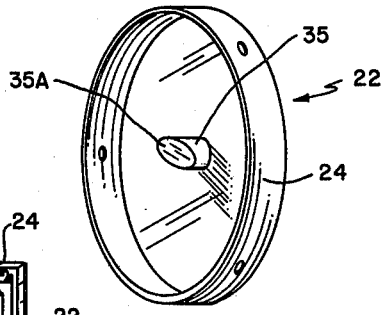
FIG. 5 is a detail perspective view of the light transmitting member of FIG. 4 shown removed from the housing.
Figure 6:
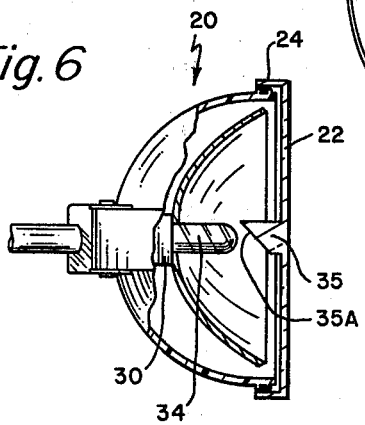
FIG. 6 is a partial plan view taken on the line 6—6 of FIG. 4.

Received in the socket 30 is a bulb member 34 and, in accordance with the invention, the light transmitting member 22 is provided at the inner side thereof with a bulb deflecting part 35 which, in one desirable construction, consists of a cylindrical extension formed integrally with the light transmitting member 22, as is more clearly shown in FIG. 5. At its inner extremity the deflector part 35 is shaped with an angled deflector surface 35A, as shown in FIG. 6, and which occurs in oblique angular relationship to the longitudinal central axis of the bulb 34.

With this arrangement, it will be apparent that inward deformation of the light transmitting member 22 will necessarily move the deflector surface 35A against the end of the bulb 34 and will thus cause the bulb to be angularly displaced or tilted sufficiently for breakage of the bulb to be avoided.

Figure 7:
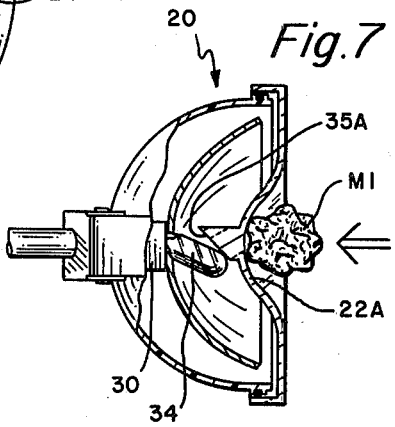
FIG. 7 is a view similar to FIG. 6 but illustrating diagrammatically the effect of impact of a foreign body on an outer side of the light transmitting member.

In FIG. 7 there is illustrated diagrammatically the deflector surface 35A having been driven into contact with the bulb 34 as a result of impact forces exerted by a moving object M1, which forces have caused the light transmitting member to be deformed as indicated by the numeral 22A. As shown in FIG. 7, contact of deflector surface 35A with the bulb 34 has moved the bulb into a tilted position without breakage occurring.

It is pointed out that bulb member 34, as shown in FIGS. 4–7, inclusive, is of a bi-pin base construction. This bulb member 34 is shown in more detail in FIG. 8. Included within a hermetically sealed glass envelope 502 is an incandescent-type filament 504 connected electrically to contact pins 506 and 508.

A suitable socket for such a bulb provides the dual functions of holding the bulb and of providing electrical connections to pins 506 and 508, and one form of such socket is shown in FIG. 9. A socket body 510 is recessed to provide an open-ended chamber 512 in which the bulb 34 is received. Electrical contact to pins 506 and 508 is made via contact rivets 514 and 516; contact is maintained by forces exerted against the pins by springs 518 and 520, respectively.

Bulb displacement as previously illustrated in FIG. 7 may also, under some circumstances, de-energize the filament. FIG. 10 illustrates this condition and may be read as an enlargement of a portion of the apparatus of FIG. 7. As in FIG. 7, surface 35A has been forced into contact with the end of bulb member 34, causing it to tilt in its socket 30. This tilting has, as shown in FIG. 10, bent contact pins 506 and 508, and such bending has caused contact pin 508 to be withdrawn from its original position (between contact rivet 516 and spring 520) and thus the filament has been de-energized.

An alternative form of bulb member which may be employed with an arrangement as noted above is illustrated in FIG. 11, and is denoted by the arrow 522. An incandescent filament 524 is housed within a hermetically sealed glass envelope 526, which is compressed at its lower end of provide a so-called "wedge base" portion 528. Electrical contact wires 530 and 532 are connected to the filament 524, issue from the base portion 528, and are bent upward on opposite sides of the base portion 528, as shown. Electrical connection may be made to these lead wires by means of contact components 534 and 536, which may be mounted in a suitable socket housing body (not shown).

In all of the arrangements shown in FIGS. 4–11, it is necessary to insure that the bulb be tilted in the longitudinal plane which includes the filament and the base connections. Tilting in any other plane may cause the base portion of the bulb to break, because the degree of tilting is restricted by the socket housing. Since the bulb will tilt in the direction of least resistance it has been found that the tilting forces exerted by the bulb deflection member should be limited throughout a range extending to approximately 45° on either side of the tilting plane and on either side of the central longitudinal axis of the bulb, as suggested diagrammatically in FIG. 12. Tilting forces will be exerted on the bulb 34 (FIG. 10) in a direction perpendicular to deflector surface 35A, and thus the deflector surface 35A must be located such that a perpendicular drawn to this surface must lie within the quadrants described as "permissible tilting forces" in FIG. 12.

It may be desired to employ a light transmitting member having a convexly domed outer surface. Such a light transmitting member is denoted by the numeral 60 in FIG. 13. In this case the deflector part 62 may be of extended length as shown.

FIG. 13 further illustrates a modification of the invention in which the light transmitting member 60 is equipped for rotatable mounting within a restricted arc of travel. Housing body 64 is provided at an outer side thereof with two opposing grooves as 66, each extending throughout an arc of approximately 90°. The light transmitting member 60 is provided on its bezel ring portion 68, with two mounting screws 70 and 72. Upon assembly of light transmitting member 60 to the housing body 64, screws 70 and 72 are advanced to enter and be received in grooves as 66. Light transmitting element 60 may, therefore, be rotated throughout the limited arc of travel defined by grooves 66.

Figure 16:
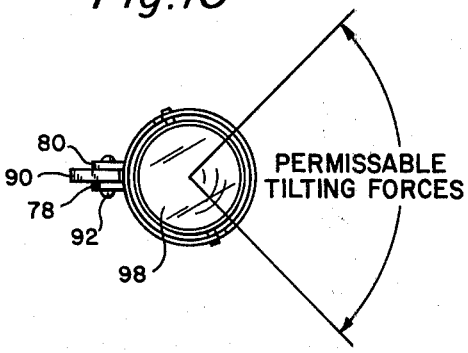
FIG. 16 is a diagrammatic representation illustrating the quadrant of permissable tilting of a bulb and socket arrangement of the type shown in FIG. 15.
Figure 17:
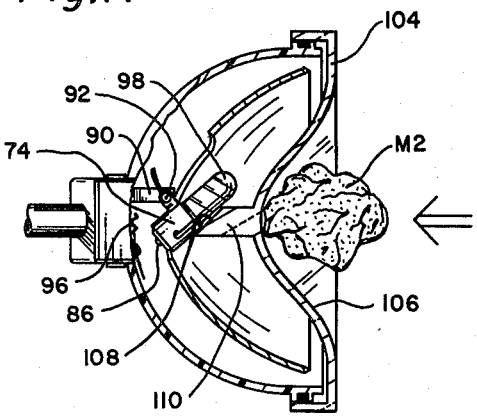
FIG. 17 is a detail cross-section of portions of the structure of FIG. 15 and illustrates diagrammatically the effect of the impact of a foreign body against a light transmitting member.

It may be desired to employ bulbs having conventional bayonet or screw-type bases. Since such a bulb is not easily yieldably mounted in a conventional socket, a rotatably mounted socket arrangement has been devised. FIG. 14 illustrates such a socket, denoted by the arrow 74 and intended to accomodate a bayonet-type bulb. It is pointed out that this Figure, as well as FIGS. 15–17, are intended to be illustrative of screw-type sockets and bulbs as well.

Socket 74 comprises a socket shell portion 76, formed at one side with two mounting flanges 78 and 80, the said flanges being pierced by pivot holes 82 and 84, respectively. Electrical contact to a bulb member is made through the shell 76 and through a bottom contact 86, more clearly shown in FIG. 15 in a conventional manner.

Figure 15:
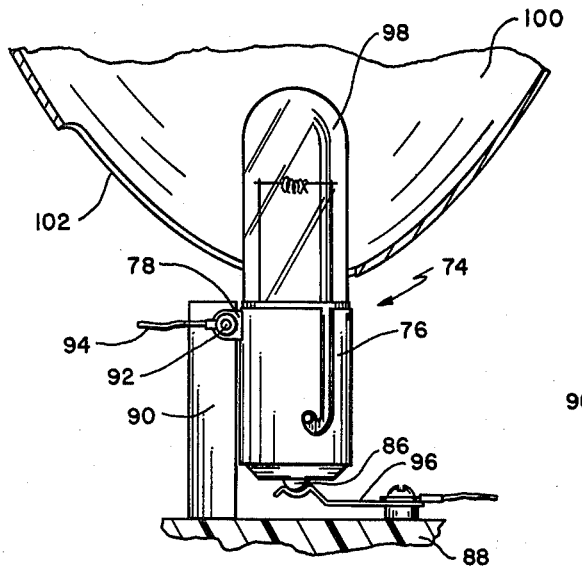
FIG. 15 is a detail fragmentary view illustrating the socket means of FIG. 14 combined with bulb means, housing, reflector and associated electrical components.

FIG. 15 illustrates the socket member of FIG. 14 mounted in a luminaire housing, a section of which housing is denoted by the numeral 88. Extending upward from housing 88 is a mounting flange 90, which is provided at its outer end with a pivot hole and which is received between mounting flanges 78 and 80 (FIG. 16) of the socket member. A pivot pin 92 is received through the various pivot holes.

Electrical contact to the socket shell 76 is made via a wire 94 which may be attached, for example, to mounting flange 78. Electrical connection to bottom contact 86 may be made via a spring-loaded detent contact 96, which provides also the additional function of yieldably holding the socket in the position shown. A bulb member 98 may then be received in the socket.

Also shown in FIG. 15 is a reflector body 100, which may include a relieved portion 102 to allow passage of bulb member 98 therethrough should the socket member 74 be pivoted through an extreme arc of travel.

The arrangement of FIG. 15 may be combined with a light transmitting member including a bulb deflector part similar to that shown in FIG. 5. As in the previous examples the bulb deflector surface of the deflector part must be in oblique angular relationship to the central longitudinal axis of the bulb member. Since socket body 74 may only pivot in one direction, a normal drawn to the bulb deflector surface must lie in the quadrant denoted "permissible tilting forces" in FIG. 16.

FIG. 17 illustrates the assembly of parts thus described having undergone an impact exerted against light transmitting member 104 by a hurtling mass of rock, M2 for example. This impact has deformed the light transmitting member 104 at portion 106, and has driven deflector surface 108 of deflector part 110 against bulb member 98. This has caused socket member 74 to pivot about pivot pin 92, and thus breakage has been avoided. In addition, this pivoting has disengaged contact 86 from its detent position with contact 96 and thus electrical current to the bulb filament has been interrupted to provide an additional safety feature.

Figure 18:
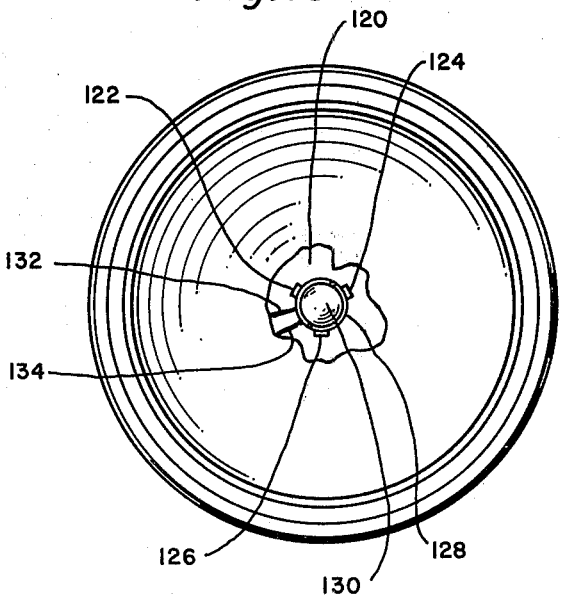
FIG. 18 is a front elevation of a modified form of luminaire apparatus with the lens removed and the reflector partially broken away to illustrate an alternate form of yieldably mounted socket.

FIGS. 18–20 inclusive illustrate yet another modification of the luminaire apparatus of the invention with which protective means of the type disclosed may be employed. A housing body 120 is provided with three yieldable socket mounting posts 122, 124 and 126, formed integrally therewith and extending upwardly therefrom. The said mounting posts are located at points 120° apart from one another, and each includes a shoulder portion as 122A (FIG. 19). A conventional socket member 128 is received between mounting posts 122, 124 and 126, and its lower extremity rests against shoulder portions as 122A to provide a reference point for focusing a light source comprising a bulb member 130, which is received in the socket 128. Electrical connection to socket member 128 may be made, for example, by wires 132 and 134, soldered directly to the shell of socket 128 and to a lower contact point 136 respectively.

Combined with this apparatus is a light transmitting member having a deflector part similar to that shown in FIG. 5. The assembly thus produced is illustrated in FIG. 20. and is shown in this figure after light transmitting member 138 had been inwardly deformed at portion 140 by the impact thereagainst of a hurtling mass of rock M4. This inward deformation has forced bulb deflecting surface 142 of deflector part 144 into contact with the bulb member 130, pushing it to one side and causing socket member 128 to be tilted within its yieldable mounting posts 122, 124 and 126. In this manner bulb breakage is avoided.

It may be desired to provide a bulb deflector part which is formed separately of a light transmitting member. Such a luminaire apparatus and arrangement is illustrated in FIG. 21. In this FIG. 21 is shown a separately formed plastic deflector part 146 similar to the part denoted by the numeral 35 in FIG. 5 and comprising a cylindrical projection having a truncated end, the plane of truncation of which lies in an oblique angular relationship to the central longitudinal axis of a bulb component of the luminaire apparatus. Affixed to and integrally formed with deflector part 146 are yieldable radial mounting arms 148, 150 and 152, each located 120° apart from one another and each equipped with mounting flanges 154, 156 and 158 which are engageable with notches 160, 162 and 164 located around the rim of housing body 166.

The primary objective of the invention, that of providing an inner impacting surface on a light transmitting member which lies in oblique angular relationship to the central longitudinal axis of a yieldably mounted bulb member may, if desired, be realized without the use of a projecting bulb deflecting part. The desirability of such an approach will be constrained by optical requirements of the luminaire apparatus. Luminaire apparatus embodying such an approach is illustrated in FIGS. 22 and 23.

FIG. 22 illustrates a housing body 168 having a socket body 170 mounted therein, and a bulb member 172 yieldably received in the socket body 170 in a manner similar to that described in FIGS. 8–10. Light transmitting member 174 includes a planar inner surface 176 which lies in a normal angular relationship to the central axis of the luminaire. However, socket member 170 is mounted such that the central axis of bulb member 172, which is received therein, does not lie along the central axis of the luminaire body but rather lies in a skewed relationship to this axis. Thus the oblique angular relationship between the central axis of the bulb member 172 and the impacting surface 176 is preserved.

FIG. 23 illustrates the luminaire apparatus of FIG. 22, showing this apparatus after its light transmitting member 174 has been struck by a hurtling mass of rock M5. Light transmitting member 174 has been deformed as a result of this impact at portion 178, and its inner surface 180 has come into contact with bulb member 172, tilting same and preventing breakage in the manner previously described.

In summary, it has been found that bulb breakage in a safety-type luminaire having a deformable light transmitting member, said breakage being caused by impact of a foreign body against an outer surface of the light transmitting member thereby deforming same such that it comes into contact with the bulb, may be eliminated by constraining the design of the luminaire apparatus such that the inner impacting surface of the light transmitting member lies in an oblique angular relationship to the central longitudinal axis of the bulb member.

We claim:

1. A safety luminaire apparatus including a housing closed at one side by a substantially rigid plastic light transmitting member having a central axis, a bulb member yieldably received in the housing and operable when energized to provide a filament in a state of incandescence for emitting radiation, a portion of the inner surface of the said light transmitting member coinciding with and substantially surrounding the said central axis and being located in close proximity to an outer end of the bulb member in a position to be driven into contact with the bulb in response to deformation resulting from impact forces exerted thereagainst, and said apparatus characterized by an obliquely disposed arrangement of parts in which means are provided for angular displacement of the bulb member when deformation of the said light transmitting member takes place inwardly along its central axis.

2. The invention of claim 1 in which the arrangement of parts includes a bulb tilting element located at the said portion of the inner surface of the light transmitting member.

3. The invention of claim 2 in which the bulb tilting element means includes an arrangement of the central longitudinal axis of the bulb member in obliquely disposed angular relationship to the said portion of the inner surface of the light transmitting member.

4. The invention of claim 1 in which the bulb is received in a socket member and the arrangement of parts includes being mounted in yieldably disposed relationship to the housing.

5. A safety luminaire apparatus including a housing closed at one side by a substantially rigid plastic light transmitting member having a central axis, a bulb member having a central longitudinal axis, said bulb member being yieldably received in the housing and operable when energized to provide a filament in a state of incandescence for emitting radiation, a portion of the inner surface of the light transmitting member coinciding with and substantially surrounding the said central axis and being located in close proximity to an outer end of the bulb member in a position to be driven into contact with the bulb in response to deformation resulting from impact forces exerted thereagainst, and said apparatus characterized by an arrangement of parts which provides for inward deformation of the light transmitting member along its central axis producing a force exerted in a direction which extends at an oblique angle to the central longitudinal axis of the bulb member.

6. A safety luminaire apparatus including a housing closed at one side by a substantially rigid plastic light transmitting member having a central axis, a bulb member yieldably received in the housing and operable when energized to provide a filament in a state of incandescence for emitting radiation, the said filament being located along the central axis of the light transmitting member and said arrangement of parts including a bulb tilting element located internally of the housing in spaced relation to an outer end of the bulb member, said bulb tilting element being arranged to be driven into contact with the bulb in response to deformation of the light transmitting member resulting from externally directed impact forces thereagainst, and said bulb tilting element having a deflecting surface lying in a plane which occurs in oblique relationship to the central longitudinal axis of the bulb to transmit deformation forces obliquely against the bulb and force it into a tilted position.

7. A safety luminaire apparatus including a housing closed at one side by a substantially rigid plastic light transmitting member having a central axis, a bulb member yieldably received in the housing and operable when energized to provide a filament in a state of incandescence for emitting radiation, the said filament being located along the central axis of the light transmitting member, a portion of the inner surface of the light transmitting member coinciding with and substantially surrounding the said central axis and being located in close proximity to an outer end of the bulb member in a position to be driven into contact with the bulb in response to deformation resulting from impact forces exerted thereagainst, and said apparatus characterized by an arrangement of parts in which means are provided for angular displacement of the bulb member when deformation of the light transmitting member takes place inwardly along its central axis and said arrangement of parts including a bulb tilting element located at the said portion of the inner surface of the light transmitting member, said bulb tilting element presenting a deflector part located at the said portion of the inner surface of the light transmitting member and presenting a deflector surface lying in a plane which occurs in oblique relation to the central longitudinal axis of the bulb member, and said deflector part being formed integrally with the light transmitting member and extending inwardly therefrom and said deflector surface occurring at the inner extremity of the deflector part.

8. The invention of claim 6 in which the bulb tilting element is formed separately of the light transmitting member and lies in closely spaced relation to an inner surface thereof.

9. The invention of claim 1 in which a central longitudinal axis of the bulb member occurs in obliquely disposed relationship to the central longitudinal axis of the light transmitting member.

* * * * *